US005219108A

United States Patent [19]

Mineki

[11] Patent Number: 5,219,108

[45] Date of Patent: Jun. 15, 1993

[54] PUNCH SHEET SEPARATION APPARATUS

[75] Inventor: Ryohachi Mineki, Tokyo, Japan

[73] Assignee: Takayoshi Mineki, Tokyo, Japan

[21] Appl. No.: 868,314

[22] Filed: Apr. 14, 1992

[30] Foreign Application Priority Data

Apr. 16, 1991 [JP] Japan ..... 3-84044

[51] Int. Cl.[5] ..... B26F 3/02

[52] U.S. Cl. ..... 225/99; 225/103; 493/373

[58] Field of Search ..... 225/99, 98, 103, 93, 225/96.5; 493/342, 373

[56] References Cited

U.S. PATENT DOCUMENTS 3,670,939 6/1972 Mueller, Jr. ..... 225/99
4,096,981 6/1978 Martorano ..... 225/99
4,461,415 7/1984 Seragnoli ..... 225/98
4,669,644 6/1987 Nilsson ..... 225/99 X

*Primary Examiner*—Eugenia Jones
*Attorney, Agent, or Firm*—Ladas & Parry

[57] ABSTRACT

An apparatus for separating a portion of a punch sheet enclosed with intermittently formed notches or cuts comprises a rotation roller, a press roller disposed above the rotation roller, a sheet feeding member for feeding the punch sheet towards the rotation roller, a pressing device for moving the press roller towards the rotation roller to snap a leading end portion of the punch sheet between the rotation roller and the press roller and an operation device operated in association with the pressing device for moving the press roller along an outer peripheral surface of the rotation roller and for separating the portion of the punch sheet enclosed with the notches or cuts from the punch roller.

11 Claims, 9 Drawing Sheets

PUNCH SHEET SEPARATION APPARATUS

BACKGROUND OF THE INVENTION

The present invention relates to an apparatus for separating a portion enclosed with intermittent notches or cuts from a sheet to which intermittent notches are formed by a label punching machine such as platen punching machine.

In the prior art of this field, when it is required to punch out labels from a label original having a surface on which prints are intermittently printed, the label original is set between a punching blade plate and a receiver plate of a punching machine and the punching blade plate is then pressed against the receiver plate to thereby form intermittent notches so as to enclose the respective labels on the label original on which the prints are intermittently printed. The label originals, each provided with the intermittent notches or cuts, are formed in plural numbers in such a method and in the next step, these plural label originals, on each of which the intermittent notches are formed and which is taken out from the punching machine, are laminated. The laminated label originals are then subjected to the punching operation by a manual working such as utilizing a hammer or by a mechanical pressing apparatus provided with a pressing plate disposed at portions corresponding to the labels, and the labels are finally punched out from the label originals by using the punching machine.

In such a conventional method, in order to separate the labels from the label originals, it is necessary to prepare a laminating device for laminating the label originals effected with the notch forming working by the punching machine and taken out therefrom and a manual or mechanical pressing device for pressing the labels to punch the same out from the laminated label originals. Accordingly, two independent steps such as label original laminating step and label pressing, i.e., separating step are required.

In these steps, in the case of a plurality of label originals having the labels or label portions having substantially the same size, shape, arrangement and like, it may be possible to perform these two independent steps by arranging the pressing device provided with the pressing plate having a size, for example, corresponding to the label portions, adjacently to the laminated label originals. However, in the other case of a plurality of label originals having the labels or label portions having different sizes, shapes, arrangements and the like, it will be necessary to perform the independent and separate laminating step for laminating groups of the label originals provided with the labels or label portions having the same size, shape and arrangement for the respective label originals and also necessary to change the pressing plates in accordance with the respective groups of the laminated label originals. Thus, these two steps cannot be continuously performed, thus being troublesome and inconvenient.

SUMMARY OF THE INVENTION

An object of the present invention is to substantially eliminate the defects or drawbacks encountered in the prior art and to provide an apparatus for separating a portion of a punch sheet, such as a label original, enclosed with intermittently formed notches or cuts, which apparatus is capable of effectively separating a punch-out portion, i.e., a label portion from the label original taken out from a punching machine regardless of the shapes, sizes, arrangements and the like thereof.

This and other object can be achieved according to the present invention by providing an apparatus for separating a portion of a punch sheet enclosed with intermittently formed notches, the apparatus comprising:

a rotation roller;

a press roller disposed above the rotation roller;

a sheet feeding member for feeding the punch sheet towards the rotation roller;

a pressing device for moving the press roller towards the rotation roller to snap a leading end portion of the punch sheet between the rotation roller and the press roller;

an operation device operated in association with the pressing device for moving the press roller along an outer peripheral surface of the rotation roller and for separating the portion of the punch sheet enclosed with the notches from the punch roller.

In preferred embodiments, in one aspect, the pressing device comprises a first disc member mounted on a rotation shaft disposed coaxially with the rotation roller, a pair of first and second lever mechanisms arranged at a peripheral portion of the first disc member to be engageable with each other, the lever mechanisms being swingably secured to the first disc member through first and second support shafts, respectively, and a connecting member secured to one of the support shafts for supporting at one end the press roller, and the operation device comprises a second disc member mounted on the rotation shaft and a Geneva mechanism operatively connected to the second disc member.

In another aspect of the preferred embodiments, the pressing device comprises a first disc member mounted on a rotation shaft disposed coaxially with the rotation roller, a support fitting arranged to a peripheral portion of the first disc member for supporting at one end the press roller, the support fitting being swingably secured to the first disc member through a support shaft and an operation fitting secured to the support shaft to be rotatable together with the support fitting, a sliding member abutting against the operation fitting and slidably contacting the rotation shaft and a solenoid for driving the sliding member, and the operation device comprises a second disc member mounted on the rotation shaft, and a servo-motor operatively connected to the second disc.

According to the separation apparatus of the above description, the leading end portion of the punch sheet fed into a gap between the rotation roller and the press roller is snapped therebetween and the punch-out portion formed on the punch sheet can be separated from the sheet frame portion by moving the press roller along the outer periphery of the rotation roller. In this operation, the separated punch-out portion is horizontally fed and the remaining frame portion is dropped down by feeding the leading end portion of the punch sheet. This operation can be continuously performed.

During the above operations, the press roller is operated by the pressing device so as to vertically move the same towards the rotation roller to snap the leading end portion of the punch sheet between the press roller and the rotation roller, and the press roller is also moved along the rotation roller by the operation device for separating the punch-out portion formed on the punch sheet from the frame portion, whereby the separation can be automatically carried out regardless of the shapes, sizes, arrangements and the like of the punch-out portions to be separated, thus being convenient and advantageous.

BRIEF DESCRIPTION OF THE DRAWINGS

For a better understanding of the present invention and to show how the same is carried out, the following detailed description is presented by way of preferred embodiments, reference being made to the accompanying drawings; in which.

DESCRIPTION OF THE PREFERRED EMBODIMENTS

A first embodiment of the present invention will be described hereunder with reference to FIGS. 1 to 13.

Figure 1:
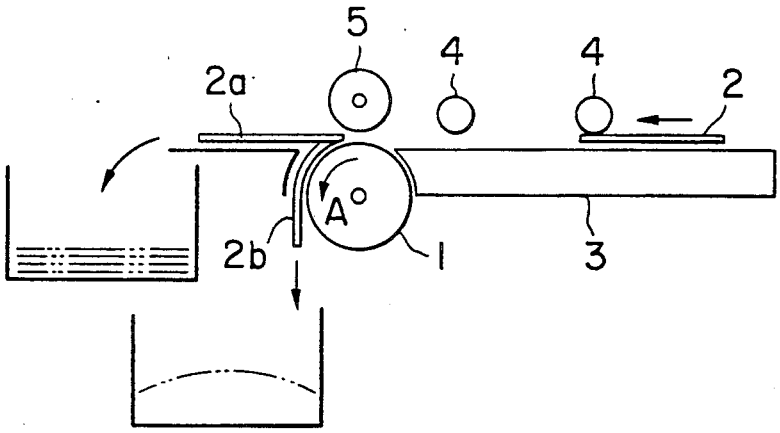
FIG. 1 is a schematic view of a punch sheet separation apparatus according to a first embodiment of the present invention.
Figure 2:
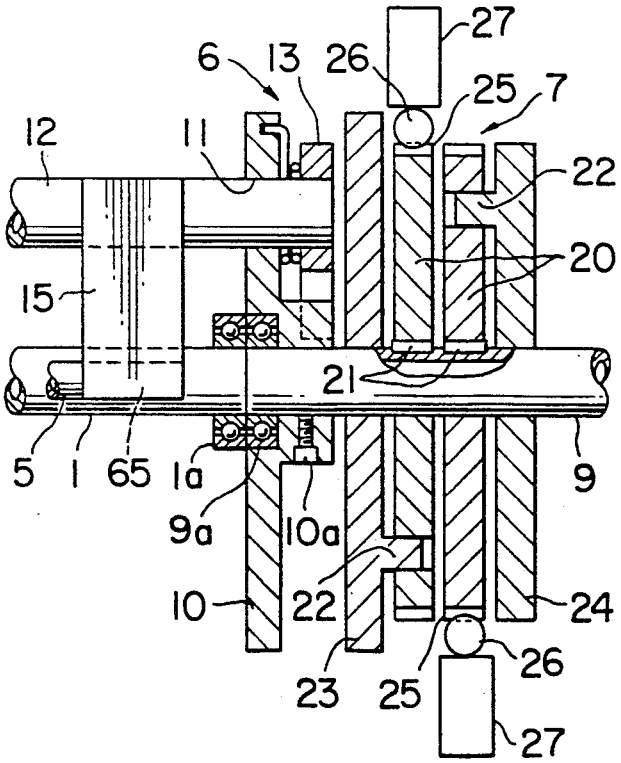
FIG. 2 is a sectional view of a pressing device and an operation device, in combination, of the separation apparatus of FIG. 1.

Referring to FIGS. 1 and 2, a separation apparatus for a sheet, which is worked by a punching operation (called merely a punch sheet hereinlater), is provided with a rotation roller 1 as a feed roller rotatably supported by an apparatus body through bearing means la. The rotation roller 1 is always rotated in the direction shown by an arrow A by driving means such as an electric motor, not shown. The roller 1 has an outer peripheral surface on which metal powder such as tungsten powder has been fused to accurately and positively feed a punch sheet 2. Feed rollers 4 are disposed above a feed bar or table 3 disposed on the upstream side of the rotation roller 1. The punch sheet 2 passing through a space between the feed rollers 4 and the feed table 3 is thereby fed along the surface of the feed table 3 towards the rotation roller 1. A press roller 5 is further disposed above the rotation roller 1. The press roller 5 can be moved vertically towards or apart from and along the outer peripheral surface of the rotation roller 1. Metal powder such as tungsten powder is fused on the outer peripheral surface of the press roller 5.

The vertical movement of the press roller 5 is performed and controlled by a press device 6 shown in FIG. 2. The movement of the press roller 5 along the outer peripheral surface of the rotation roller 1 is performed by an operation device 7 also shown in FIG. 2 in association with the press device 6.

More specifically, the press roller 5 acts to snap and hold the front end of the punch sheet 2 between the press roller 5 and the rotation roller 1 by the vertical movement of the press roller 5 towards the rotation roller 1. Notches are intermittently formed on the punch sheet so as to enclose a punch-out portion 2*a* of the sheet 2, and the press roller 5 separates the punch-out portion 2*a* from the punch sheet 2 during the movement along the outer peripheral surface of the rotation roller 1. The separated punch-out portion 2*a* is then fed in a horizontal direction towards the downstream side of the roller 1 as shown in FIG. 1. The remaining portion 2*b*after the separation of the punch-out portion 2*a* falls downward of the rotation roller 1 into a scrap storage container, for example. In order to positively perform this separation working, a one-way clutch 65 is provided for the press roller 5 to prevent the press roller 5 from being rotated in the direction reverse to the rotating direction of the rotation roller 1 when the press roller 5 moves along the outer peripheral surface of the rotation roller 1.

Figure 3:
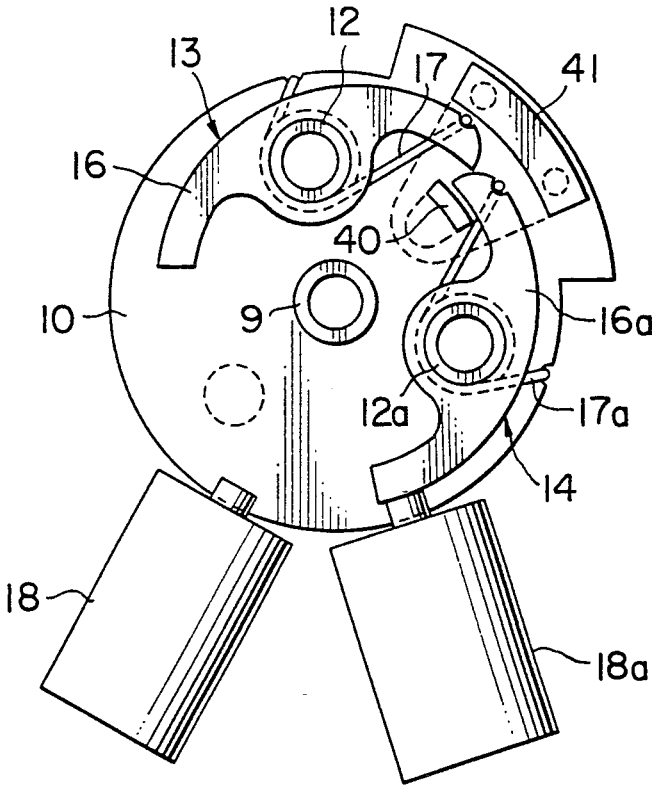
FIG. 3 is an illustration of the pressing device of FIG. 2.

The press device 6, as shown in FIGS. 2 and 3, comprises a rotation shaft 9 supported by a bearing 9*a* so as to be disposed on the same axial line as that of the rotation roller 1, a disc member 10 mounted on the rotation shaft 9 through a fixing means such as bolt 10*a*, support shafts 12 and 12*a* passing through openings 11, 11 formed to the peripheral portions of the disc member 10 concentrically with respect to the rotation shaft 9 with a separation angle of 120°, lever mechanisms 13 and 14 secured to the support shafts 12 and 12*a*, and a coupling or connecting member 15 having a central portion which is supported by the one (12) of the support shafts 12 and 12*a* which is positioned in the forward position of the rotating direction of the rotation roller 1.

Figure 4:
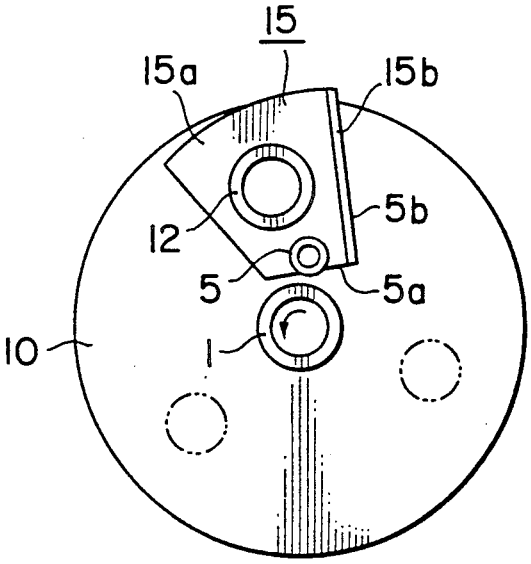
FIG. 4 is an illustration of a press roller in connection with a rotation roller in their initial positions.

As shown in FIG. 4, the coupling member 15 has a plurality of fixing plates 15*a* mounted on the support shaft 12 with equal spaces with each other and a connection plate 15*b* for connecting these fixing plates 15*a*. The fixing plate 15*a* is provided with an opening formed on the end side of the fixing plate 15*a*. The press roller 5 is insertion supported by this opening. The fixing plate 15*a* is further provided with an end face 5*a* facing the press roller 5 and positioned inside the outer surface of the press roller 5 and is also provided with a side face 5*b* continuous to the end face 5*a*, which is positioned in the same horizontal plane as the outer surface of the rotation roller 1 when the fixing plate 15*a* is rotated from the initial position to a specific position.

As shown in FIG. 3, the lever mechanism 13 comprises a lever member 16 having a central portion positioned by the support shaft 12 to be swingable thereabout, a spring means 17 for urging the lever member 16 in the direction reverse to the rotating direction A of the rotation roller 1, and a solenoid means 18 for moving the lever member 16 in the same direction as the rotating direction of the rotation roller 1. On the other hand, the lever mechanism 14 comprises a lever member 16*a* having a central portion positioned by the support shaft 12*a* to be swingable thereabout, a spring means 17*a* for urging the lever member 16*a* in the same direction as the rotating direction A of the rotation roller 1, and a solenoid means 18*a* for moving the lever member 16*a* in the direction reverse to the rotating direction of the rotation roller 1. According to this structure, the press roller 5 is moved towards or apart from the rotation roller 1 through the engagement or disengagement between the lever members 16 and 16*a*. That is, in the initial stage, one end portion of the lever member 16*a* abuts against a stopper piece 40 under the urging force of the spring means 17*a*, and an end portion of the lever member 16, whose movement is limited by a stopper piece 41 disposed radially outwardly, is engaged with the end portion of the lever 16*a*, thereby determining the angular position of the support shaft 12.

Figure 5:
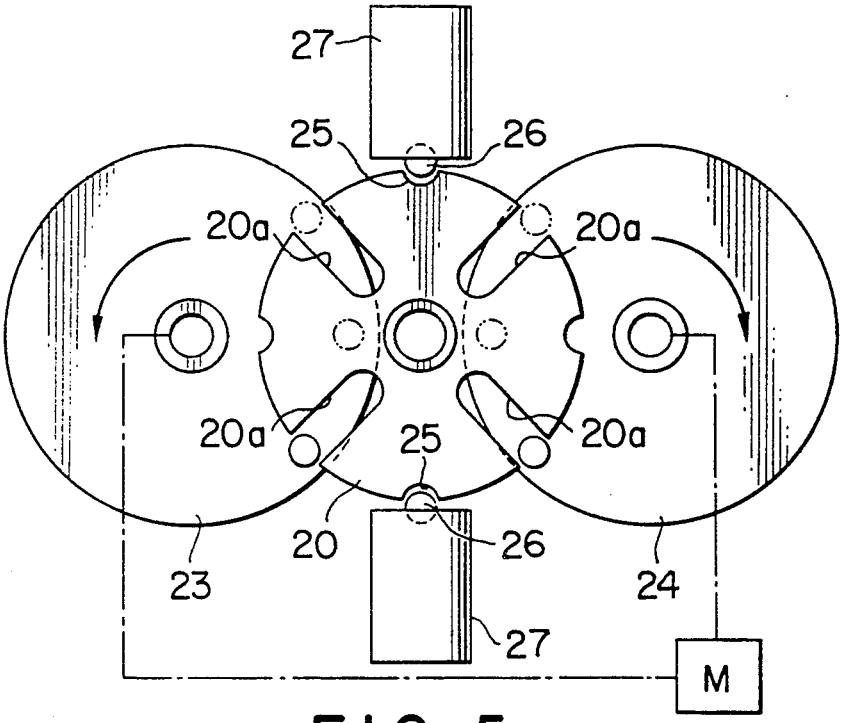
FIG. 5 is a schematic view of the operation device of FIG. 2.

As shown in FIGS. 2 and 5, the operation device 7 comprises two Geneva drives or gears 20, 20 each provided with four grooves 20*a* with 90° separated angular relationship with each other and mounted on the rotation shaft 9 and fixed by key members 21, 21, two disc members 23 and 24 having projecting pins 22 each to be fitted into the groove 20*a* of the Geneva gear 20 and mounted rotatably on the rotation shaft 9, and a servomotor means M for independently driving the disc members 23 and 24. The positioning of the Geneva gears 20, 20 is performed by fitting balls 26 into recesses 25 formed on the outer peripheral surfaces of the Geneva gears 20, 20. Such a ball fitting operation may be carried out by means of plungers 27, for example. One (23) of the disc members 23 and 24 is utilized for moving the press roller 5 along the outer peripheral surface of the rotation roller 1 and the other one (24) is utilized on the contrary for returning the press roller 5 to the initial position.

The first embodiment of the punch sheet separation apparatus according to the present invention operates in the following manner.

Figure 6:
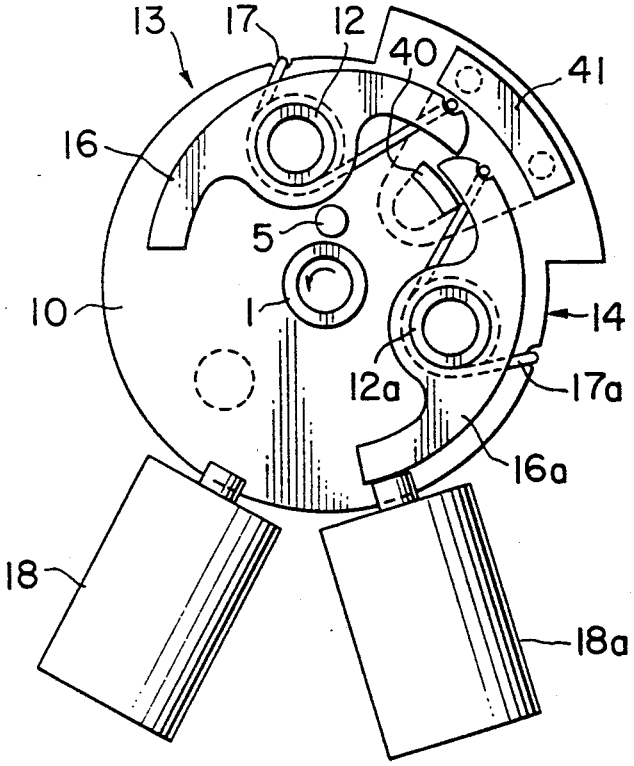
FIG. 6 shows an arrangement of respective members of the pressing device in the first stage in operation.
Figure 10:
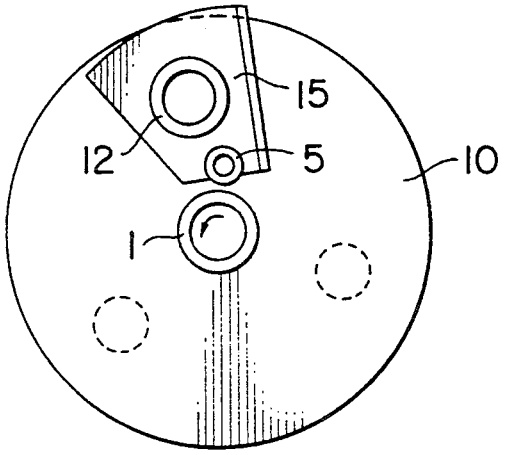
FIGS. 10, 11, 12 and 13 are views showing positional relationship of the press roller with respect to the rotation roller in the first, second, third and fourth stages in the operations, respectively, corresponding to the stages shown in FIGS. 6, 7, 8 and 9.

The punch sheet 2, on which punch-out portion 2*a* to be separated is enclosed with the notches or cuts, is fed by the rotation of the feed rollers 4 along the feed table 3 towards the rotation roller 1. In this feeding operation, at a stage before the punch sheet 2 reaches the rotation roller 1, as shown in FIG. 6, one lever member 16 positionally fixed to the support shaft 12 for the lever mechanism 13 is urged by the spring means 17 in the direction reverse to the rotating direction of the rotation roller 1. The lever member 16 is engaged with the other lever member 16*a* secured to the support shaft 12*a* for the lever mechanism 14 and pressed by the solenoid means 18*a*. Under the engagement between both the lever members 16 and 16*a*, the press roller 5 supported by the fixing plate 15*a* secured to the support shaft 12 forms a gap between it and the rotation roller 1 sufficient for the insertion of the punch sheet 2, as shown in FIG. 10.

Figure 7:
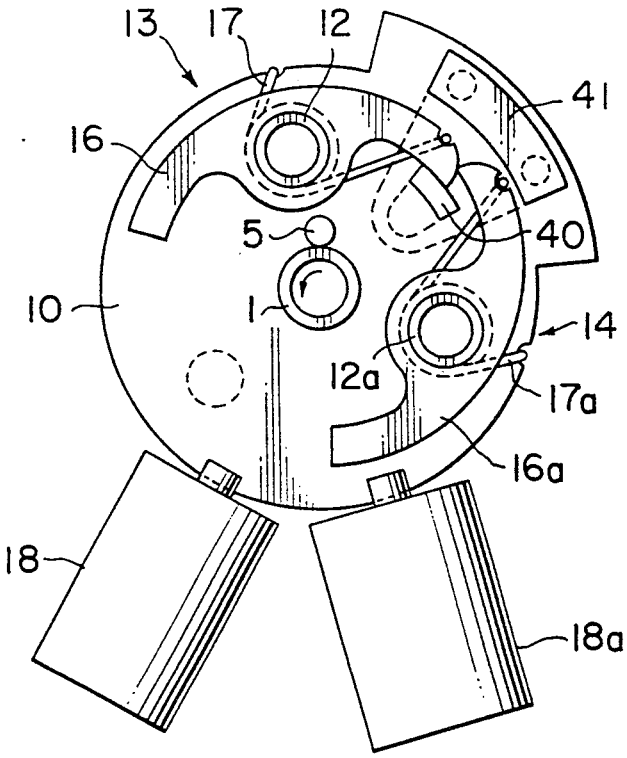
FIGS. 7, 8 and 9 show arrangements of the respective members of the pressing device in the second, third and fourth stages in accordance with their operation order.
Figure 11:
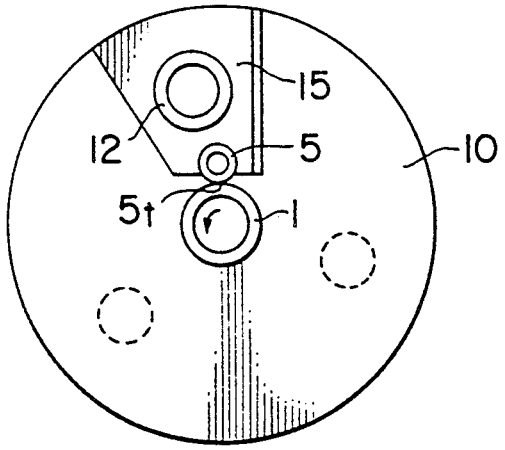

The punch sheet 2 further advances along the feed table 3, and, when the front end portion thereof reaches a position just before the rotation roller 1, the solenoid means 18*a* is actuated to push out a rod of the solenoid means 18*a*. By this motion, the lever member 16*a* secured to the support shaft 12*a* is rotated in the direction reverse to the rotating direction of the rotation roller 1. Then, the lever member 16 is disengaged from the lever member 16*a*, as shown in FIG. 7, and the lever member 16 is rotated to a position at which the lever member 16 caused to abut against the stopper piece 40 by the spring means 17. According to this swing rotation of the lever member 16, the support shaft 12 is also rotated by an amount corresponding to the rotation amount of the lever member 16, whereby the press roller 5 supported by the fixing plate 15*a* is moved towards the rotation roller 1 to snap the punch sheet 2 between the press roller 5 and the rotation roller 1 as shown in FIG. 11. The snapped portion of the punch sheet 2 between these rollers 1 and 5 is a frame portion corresponding to the scrap portion 2*b* of the punch sheet 2, and the determination of this position can be controlled by a control means, not shown.

Figure 12:
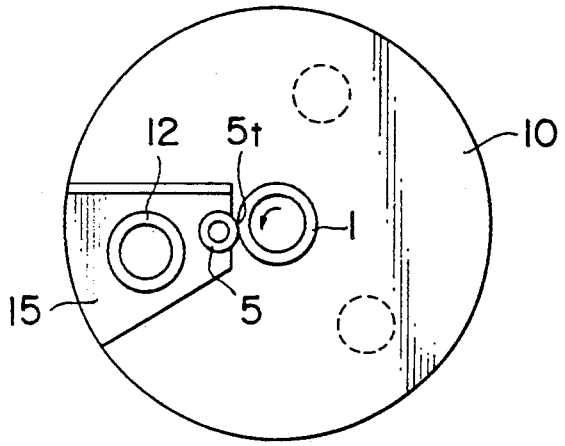

At a time when the press roller 5 and the rotation roller 1 snap the frame portion 2*b* of the punch sheet 2 fed into the gap between these rollers 5 and 1, the servomotor M of the operation device 7 is driven to rotate one time the disc member 23. By this rotation of the disc member 23, the Geneva gear 20 is rotated by a predetermined angle such as 90° through the pins 22 disposed on the disc member 23. Since the Geneva gear 20 is secured to the rotation shaft 9 by means of the key 21, the rotation shaft 9 is also rotated, and hence, the disc member 10 and the support shafts 12 and 12*a* are also rotated together by 90°, for example. Next, as a result of the rotation of the support shaft 12, the press roller 5 of the fixing plate 15*a* mounted on the support shaft 12 moves, as shown in FIGS. 11 and 12, along the outer peripheral surface of the rotation roller 1. During this motion, although the press roller 5 is subjected to the rotating force by the rotation roller 1, the press roller 5 is not rotated in the direction reverse to the rotating direction of the rotation roller 1 because of the location of the one-way clutch 65 provided for the press roller 5, so that the press roller 5 is always moved in one point contact to the rotation roller 1 at a portion 5*t*. That is, it may be said that the position of the press roller 5 with respect to the fixing plate 15*a* is not changed. The frame portion 2*b* of the punch sheet 2 snapped between the press roller 5 and the rotation roller 1 is fed in thus manner towards the downstream direction. In this feeding operation, the punch-out portion 2*a* separated from the punch sheet 2 is fed in the downstream horizontal direction as shown in FIG. 1 by a cooperative operation of the rotating force of the rotation roller 1 and the feed rollers 4. The thus separated punch-out portion 2*a* is then fed to an accommodation means 2*d*, in FIG. 1, for the classification and accommodation thereof.

Figure 8:
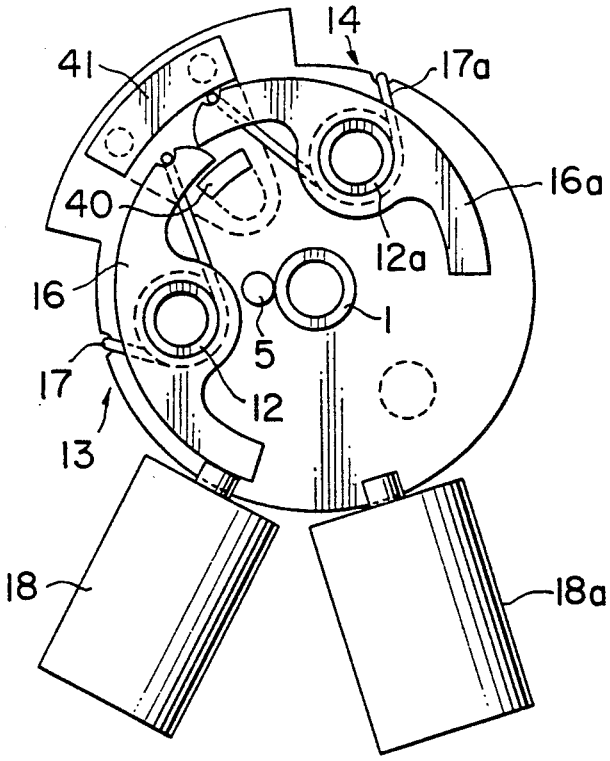
Figure 9:
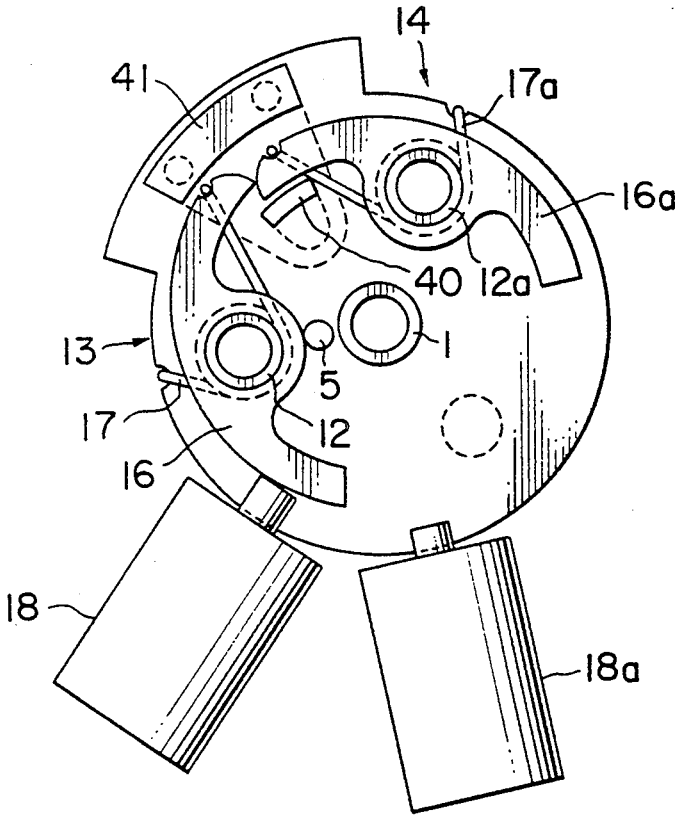
Figure 13:
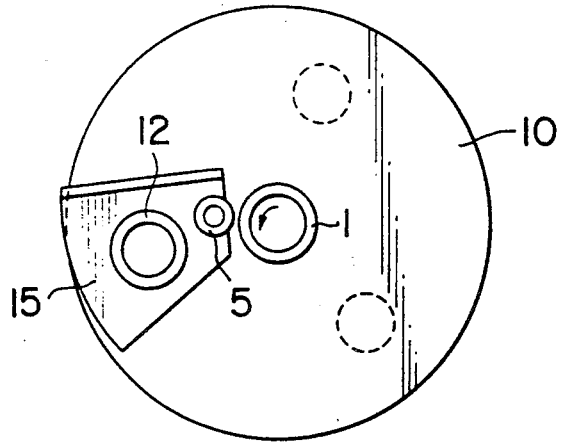

The position of the disc member 23 after a 90° movement by means of the operation device 7 is shown in FIG. 8. This position is a position in which the lever members 16 and 16*a* shown in FIG. 6 are rotated by necessary angles, and the related positions of the rotated lever members 16 and 16*a* are relatively the same as the positions shown in FIG. 6. Under these conditions, when the solenoid means 18 is operated, the rod of the solenoid means is pushed outward, the lever member 16*a* secured to the support shaft 12 thereby being rotated in the same direction as the rotating direction of the rotation roller 1. Then, the lever member 16 is released from the stopper piece 40 as shown in FIG. 9 and the lever member 16*a* is rotated to the position at which the lever member 16*a* abuts against the stopper piece 40. As a result of the rotation of the lever member 16, the support shaft 12 is also rotated by an amount corresponding to the rotation of the lever member 16, and the press roller 5 secured to the fixing plate 15*a* is moved in accordance with the rotation of the support shaft 12 as shown in FIG. 13 in a direction apart from the rotation roller 1 at a time just before the completion of the separation. At this time, the frame portion 2*b* snapped between the press roller 5 and the rotation roller 1 drops into the scrap container 2*c* disposed downward of the rotation roller 1.

At a time when the press roller 5 is moved to a position apart from the rotation roller 1 as shown in FIG. 13, the servo-motor M for the operation device 7 is driven to rotate one time the disc member 24, and as a consequence of the rotation of the disc member 24, the Geneva gear 20 is rotated by a necessary angle, 90° for example, for the returning thereof through the pins 22 provided for the disc member 24. Then, the rotation shaft 9 is also rotated and the disc member 10 and the support shafts 12 and 12*a* are also rotated together by 90°, for example. As a result of the rotation of the support shaft 12, the press roller 5 and the fixing plate 15*a* mounted on the support shaft 12 are returned to the initial positions shown in FIG. 10. Substantially the same operations are thereafter repeated as necessary.

A second embodiment of the present invention will now be described hereunder with reference to FIGS. 14 and 15, in which like reference numerals are used to designate like members or portions corresponding to those of the first embodiment, and the details thereof are now omitted.

Figure 14:
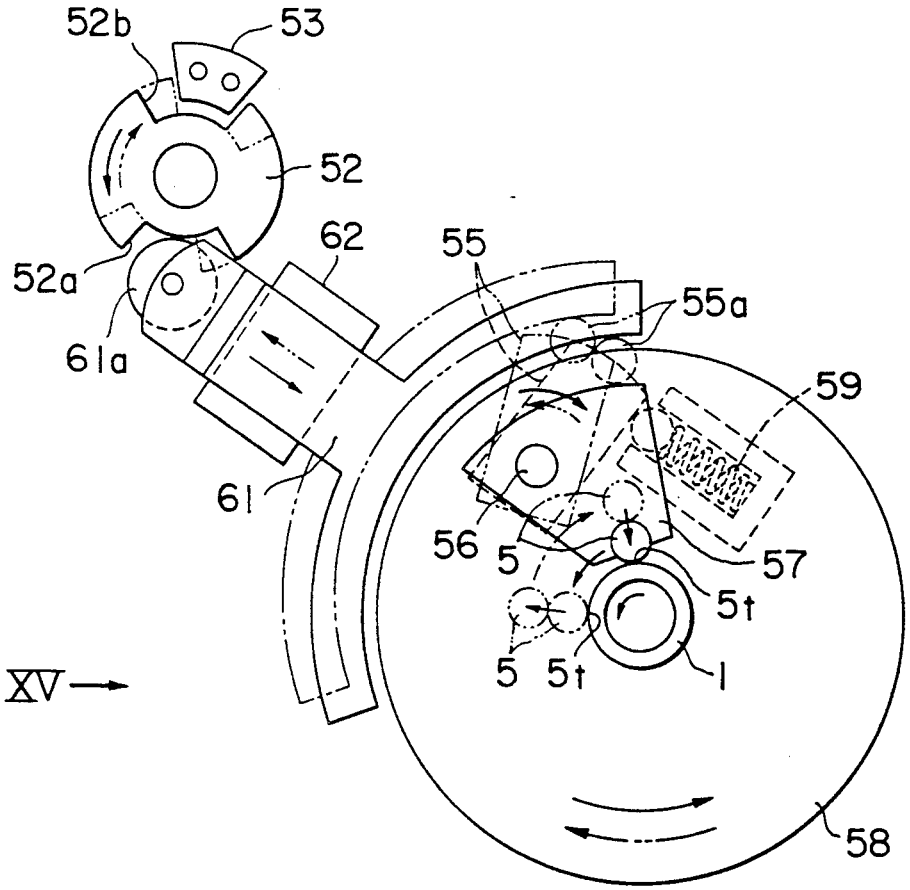
FIG. 14 is a schematic view of a pressing device and an operation device, in combination, of the second embodiment according to the present invention.
Figure 15:
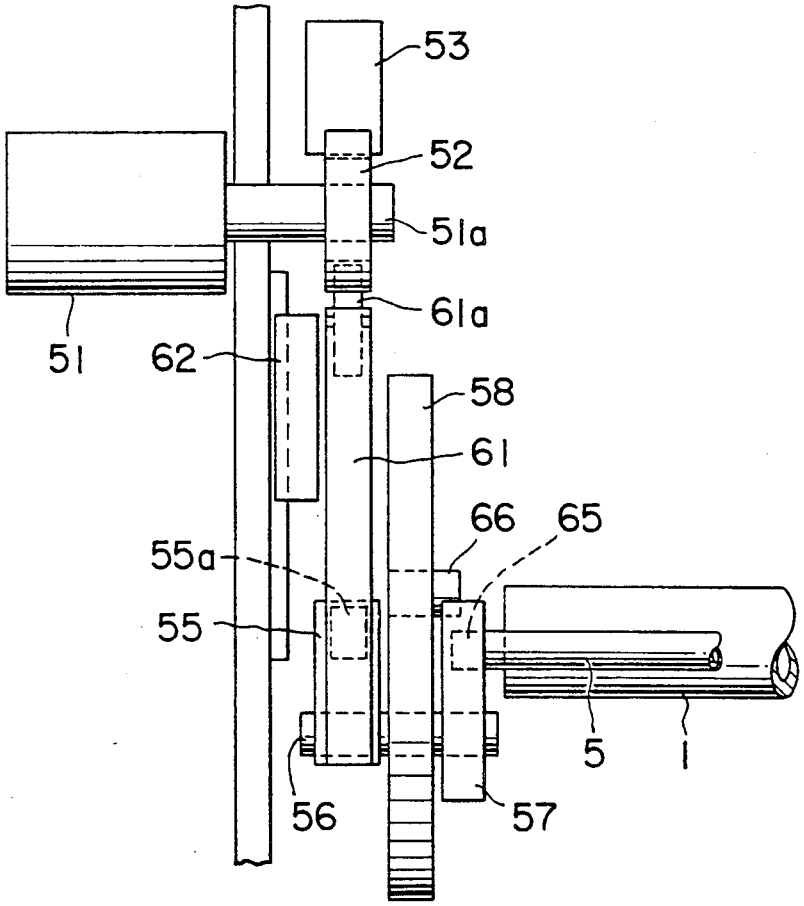
FIG. 15 is a view viewed from an arrowed direction of XV in FIG. 14.

Referring to FIGS. 14 and 15, in this embodiment, the press roller 5 disposed above the rotation roller 1 is supported rotatably by a support fitting 57. The press roller 5 is provided with a one-way clutch 65 by which the rotation of the press roller 5 reverse to the rotating direction of the rotation roller 1 is prevented.

The support fitting 57 is supported rotatably through a support shaft 56 on a peripheral portion of a disc member 58 disposed coaxially with the rotation roller 1. An operation fitting 55 is secured to an end portion, opposite to the support fitting 57, of the support shaft 56. When the operation fitting 55 is rotated about the support shaft 56, the support fitting 57 secured to the support shaft 56 is also rotated together therewith.

As shown in FIG. 15, a crescent shape sliding member 61 is disposed in parallel to the disc member 58 in a manner such that an operation roller 55*a* secured to an operation fitting 55 mounted on the support shaft 56 is pressed by an inner surface of the crescent shape sliding member 61 to thereby rotate the operation fitting 55 about the support shaft 56.

The crescent shape sliding member 61 is formed to be slidable along a guide 62 in the arrow direction. A drive roller 61*a* is further provided at one end of the sliding member 61. A rotary solenoid 51 is provided for this embodiment, and the rotary solenoid 51 has a driving shaft 51*a* on which a cam 52 provided with a notch 52*a* is mounted. With the notch 52*a* is engaged the driving roller 61*a* of the sliding member 61.

As shown in FIG. 14, a spring means 59 is disposed on an end face opposite to the operation roller 55*a* of the operation fitting 55 for urging the operation fitting 55 in the counterclockwise direction. The cam 52 is further provided with a notch 52*b*, on a side opposite to the location of the notch 52*a*, which is engaged with a stopper piece 53.

The apparatus of the second embodiment of the present invention operates in the following manner.

Referring to FIGS. 14 and 15, when the advancing of the punch sheet 2, as shown in FIG. 1, into the gap between the rotation roller 1 and the press roller 5 is detected by a light sensor, for example, the rotary solenoid 51 is supplied with current to thereby rotate the cam 52 in the counterclockwise direction as shown by the solid line arrow in FIG. 14. As a result of the rotation of the cam 52, the drive roller 61*a* of the sliding member 61 is rotated in engagement with the notch 52*a* of the cam 52 with the drive roller 61*a*, and hence, the sliding member 61 is moved towards the rotation roller 1.

In this operation, the operation roller 55*a* of the operation fitting 55 is pressed by the inner surface of the sliding member 61 and the operation fitting 55 is hence rotated against the urging force of the spring means 59 about the support shaft 56 in the clockwise direction as shown by the broken line arrow shown in FIG. 14. As a result of the rotation of the operation fitting 55, the support fitting 57 secured to the support shaft 56 is also rotated in the clockwise direction, whereby the punch sheet 2 is snapped between the rotation roller 1 and the press roller 5 supported by the support fitting 57.

In the next step, the disc member 58 is rotated in the counterclockwise direction as shown by the solid line arrow in FIG. 14. The press roller 5 is then moved along the outer peripheral surface of the rotation roller 1. During this operation, although the press roller 5 is subjected to rotation force in contact with the rotation roller 1, the rotation of the press roller 5 in the direction reverse to the rotating direction of the rotation roller 1 is prevented by the location of the one-way clutch 65, so that the press roller 5 is moved always in one point abutment against the rotation roller at one portion.

During this operation, the rotation roller 1 is rotating in the counterclockwise direction, and hence, the frame portion 2*b* of the punch sheet 2 snapped between the rotation roller 1 and the press roller 5 drops as shown in FIG. 1. At the same time, the punch-out portion 2*b* of the punch sheet 2 separated from the frame portion 2*b* is fed horizontally forwardly by the associated operation of the rotating force of the rotation roller 1 and the feed rollers 4 and then fed into an accommodation means 2*d* by which the punch-out portion 2*b* is classified and accommodated as described with respect to the first embodiment.

When the current to the rotary solenoid 51 is turned off, the rotary solenoid 51 returns to its initial position by the actuation of a spring means, not shown, disposed therein. During this operation, the cam 52 rotates in the clockwise direction shown by the broken line arrow in FIG. 14 and stops at a position at which the notch 52*b* of the cam 52 abuts against the stopper piece 53. The rotation of the cam 52 moves the crescent shape sliding member 61 in a direction apart from the rotation roller 1. At the same time, the operation fitting 55 is rotated by the urging force of the spring 59 about the support shaft 56 in the counterclockwise direction shown by the broken line arrow in FIG. 14. The press roller 5 is thereby separated from the rotation roller 1.

Next, the disc member 58 is rotated in the clockwise direction shown by the broken line arrow in FIG. 14, and the press roller 5 returns to its initial position above the rotation roller 1. These operations are repeated.

Further, with reference to FIG. 15, according to the second embodiment the disc member 58 is driven by a servo-motor 66 by which the operation device, corresponding to the operation device 7 of the first embodiment, is constituted, and the press device, corresponding to that 6 of the first embodiment, comprises the disc member 58, the operation fitting 55, the support fitting 57, the sliding member 61, the cam 52 and the rotary solenoid 51.

According to the separation apparatus of the present invention, the leading end portion of the punch sheet fed into a gap between the rotation roller and the press roller is snapped therebetween and the punch-out portion formed on the punch sheet can be separated from the sheet frame portion by moving the press roller along the outer periphery of the rotation roller.

During the above operations, the press roller is operated by the pressing device so as to vertically move the same towards the rotation roller to snap the leading end portion of the punch sheet between the press roller and the rotation roller, and the press roller is also moved along the rotation roller by the operation device for separating the punch-out portion formed on the punch sheet from the frame portion, whereby the separation can be automatically carried out regardless of the shapes, sizes, arrangements and the like of the punch-out portions to be separated, thus being convenient and advantageous.

It is to be understood that the present invention is not limited to the described preferred embodiments and many other changes and modifications may be made without departing from the scope of the appended claims.

What is claimed is:

1. An apparatus for separating a portion of a punch sheet enclosed with intermittently formed notches comprising:

a rotation roller;

a press roller disposed above the rotation roller;

feed means for feeding the punch sheet towards the rotation roller;

pressing means for moving the press roller towards the rotation roller to snap a leading end portion of the punch sheet between the rotation roller and the press roller;

operation means provided independently of the pressing means for moving the press roller along an outer peripheral surface of the rotation roller and for separating a portion of the punch sheet enclosed with notches from the punch sheet.

2. An apparatus according to claim 1, wherein the pressing means comprises a first disc member mounted on a rotation shaft disposed coaxially with the rotation roller, a pair of first and second lever mechanisms arranged at a peripheral portion of the first disc member to be engageable with each other, said lever mechanisms being swingably secured to the first disc member through first and second support shafts, respectively, and a connecting member secured to one of the support shafts for supporting at one end the press roller, and wherein the operation means comprises a second disc member mounted on the rotation shaft and a Geneva mechanism operatively connected to the second disc member.

3. An apparatus according to claim 2, wherein the first lever mechanism comprises a first lever member secured to the first support shaft to be swingable, a first spring means for urging the first lever member in the direction reverse to a rotating direction of the rotation roller and a first solenoid means for rotating the first lever member in the same direction as the rotating direction of the rotation roller, and said second lever mechanism comprises a second lever member secured to the second support shaft to be swingable, a second spring means for urging the second lever member in the same direction as the rotating direction of the rotation roller and a second solenoid means for rotating the second lever member in a direction reverse to the rotating direction of the rotation roller.

4. An apparatus according to claim 2, wherein the operation means further includes a servo-motor means for rotating the second disc member, and wherein the second disc member includes two discs independently driven by the servo-motor means and provided with a plurality of projection pins, and the Geneva mechanism includes two Geneva gears mounted on the rotation shaft and held thereon by means of keys, respectively, each of said Geneva gears being provided with a plurality of grooves arranged in equally angularly separated relationship around the outer periphery of the Geneva gear, said grooves being operatively engaged with the projection pins of the disc.

5. An apparatus according to claim 4, wherein the Geneva gear is provided with four grooves arranged around the outer periphery of the Geneva gear and separated by angles of 90° from each other.

6. An apparatus according to claim 1, wherein the pressing means comprises a first disc member mounted on a rotation shaft disposed coaxially with the rotation roller, a support fitting means arranged at a peripheral portion of the first disc member for supporting at one end the press roller, the support fitting means being swingably secured to the first disc member through a support shaft, drive fitting means secured to the support shaft to be swingable together with the support fitting means, a sliding member abutting against the drive fitting means and means for driving the sliding member, and wherein the operation means comprises servo-motor means operatively connected to the first disc member.

7. An apparatus according to claim 6, wherein the pressing means further includes a spring means secured to the first disc for urging the support fitting means in the counterclockwise direction.

8. An apparatus according to claim 6, wherein the sliding member has a crescent shape and the operation fitting means includes an operation roller against which the sliding member abuts.

9. An apparatus according to claim 6, wherein the the sliding member is provided with a driving roller and wherein the driving means for driving the sliding member comprises a solenoid means, a driving shaft extending from the solenoid means and a cam means mounted on the driving shaft, said cam means being provided with a notch with which the driving roller of the sliding member is engaged.

10. An apparatus according to claim 9, wherein the driving means further includes a stopper member and the cam member is provided with a further notch with which the stopper member is engaged.

11. An apparatus according to claim 1, wherein the press roller is provided with a one-way clutch means for preventing the press roller from being rotated in the direction reverse to a rotating direction of the rotation roller.

* * * * *